US006742201B2

(12) United States Patent
Porcheron

(10) Patent No.: US 6,742,201 B2
(45) Date of Patent: Jun. 1, 2004

(54) DEVICE FOR TRANSFERRING A PERSON

(75) Inventor: Franaois Porcheron, Lyons (FR)

(73) Assignee: IDC Medical, Les Echets (FR)

( * ) Notice: Subject to any disclaimer, the term of this patent is extended or adjusted under 35 U.S.C. 154(b) by 0 days.

(21) Appl. No.: 10/317,057

(22) Filed: Dec. 12, 2002

(65) Prior Publication Data

US 2003/0110561 A1 Jun. 19, 2003

(30) Foreign Application Priority Data

Dec. 13, 2001 (FR) ..... 01 16150

(51) Int. Cl.[7] ..... A61G 7/10
(52) U.S. Cl. ..... 5/86.1; 5/81.1 R
(58) Field of Search ..... 5/86.1, 81.1 R, 5/81.1 RP; 280/47.131

(56) References Cited

U.S. PATENT DOCUMENTS

| | | | | |
|---|---|---|---|---|
| 3,911,509 A | | 10/1975 | Fleckenstein | 5/507.1 |
| 4,934,003 A | * | 6/1990 | Hayakawa et al. | 5/81.1 RP |
| 5,054,137 A | | 10/1991 | Christensen | 5/81.1 RP |
| 5,189,741 A | * | 3/1993 | Beardmore | 5/86.1 |
| 5,507,044 A | | 4/1996 | Williamson et al. | 5/81.1 RP |
| 5,916,085 A | * | 6/1999 | Wells | 5/81.1 R |
| 6,026,523 A | * | 2/2000 | Simon et al. | 5/81.1 R |
| 6,276,007 B1 | * | 8/2001 | Brown | 5/81.1 R |
| 6,568,002 B1 | * | 5/2003 | Liljedahl | 5/86.1 |
| 6,665,894 B2 | * | 12/2003 | Moffa et al. | 5/86.1 |
| 2002/0010961 A1 | * | 1/2002 | Brown | 5/81.1 RP |
| 2003/0110561 A1 | * | 6/2003 | Porcheron | 5/86.1 |
| 2003/0208844 A1 | * | 11/2003 | Moffa et al. | 5/86.1 |

FOREIGN PATENT DOCUMENTS

| | | |
|---|---|---|
| DE | 2749146 | 5/1978 |
| WO | 98 38959 | 9/1998 |

* cited by examiner

*Primary Examiner*—Robert G. Santos
(74) *Attorney, Agent, or Firm*—Dennison, Schultz, Dougherty & MacDonald

(57) ABSTRACT

A person-transfer device comprises:

a stand defining a support polygon;

a pole rising vertically from the stand;

a rest assembly for the lower limbs of a person, the rest assembly being pivotally mounted on the pole; and a person transfer system adapted to move within the support polygon between an initial position and a final position, which positions are angularly offset relative to each other, the transfer system being mounted on the pole, being provided with a suspension assembly for the upper limbs that is pivotally mounted on the pole to pivot about an axis that is inclined relative to the vertical and that is designed to be placed at a high level so as to turn under the effect of the weight of the suspended person to a low level, thereby enabling the person to be transferred.

10 Claims, 6 Drawing Sheets

DEVICE FOR TRANSFERRING A PERSON

The present invention relates to the technical field of devices designed for enabling a person whose physical capacities are deficient, whether temporarily or permanently, to be transferred between two positions that are relatively close to each other.

BACKGROUND OF THE INVENTION

For people suffering from a physical handicap, moving from one position to another constitutes a real difficulty. This applies in particular for moving from a prone position to a sitting position, or vice versa, or for passing from a position of sitting in a chair to a position of sitting in a wheelchair, for example. Furthermore, such a person cannot perform such a transfer on their own and must call on help.

In the state of the art, various devices have been proposed, in generally electrically driven devices, that are adapted to handling handicapped people. Those devices are generally bulky, expensive, and require an electrical power supply.

OBJECT AND SUMMARY OF THE INVENTION

There is therefore a need for a device that is simple and adapted to enable a person to transfer from one position to another, such transfer being provided in a manner that is safe without necessarily requiring help from another person.

There is also a need for a simple device designed to transfer a person who possesses good physical capacities in the upper limbs.

The object of the invention is thus to satisfy this need by proposing a device which is simple, compact, and designed for transferring a person from one position to another in complete safety and without necessarily requiring outside help.

To achieve this object, the device of the invention for transferring a person comprises:

- a stand defining a support polygon;
- a pole rising vertically from the stand;
- a rest assembly for the lower limbs of a person, the rest assembly being pivotally mounted on the pole; and
- a person transfer system adapted to move within the support polygon between an initial position and a final position, which positions are angularly offset relative to each other, the transfer system being mounted on the pole, being provided with a suspension assembly for the upper limbs that is pivotally mounted on the pole to pivot about an axis that is inclined relative to the vertical and that is designed to be placed at a high level so as to turn under the effect of the weight of the suspended person to a low level, thereby enabling the person to be transferred.

BRIEF DESCRIPTION OF THE DRAWINGS

Various other characteristics of the invention appear from the following description made with reference to the accompanying drawings which show an embodiment of the invention as a non-limiting example.

MORE DETAILED DESCRIPTION

Figure 1:
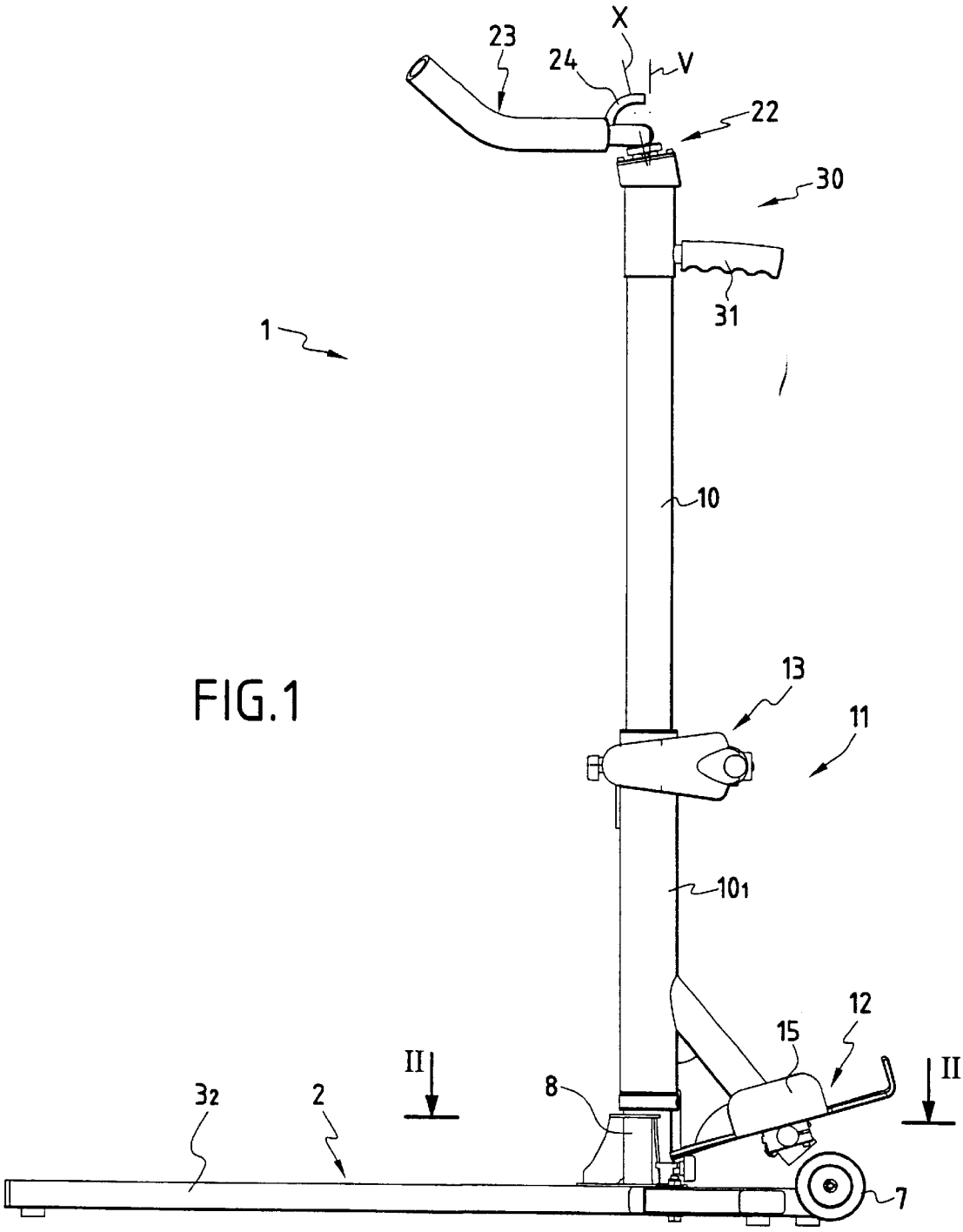
FIG. 1 is an elevation view showing the device in accordance with the invention.
Figure 2:
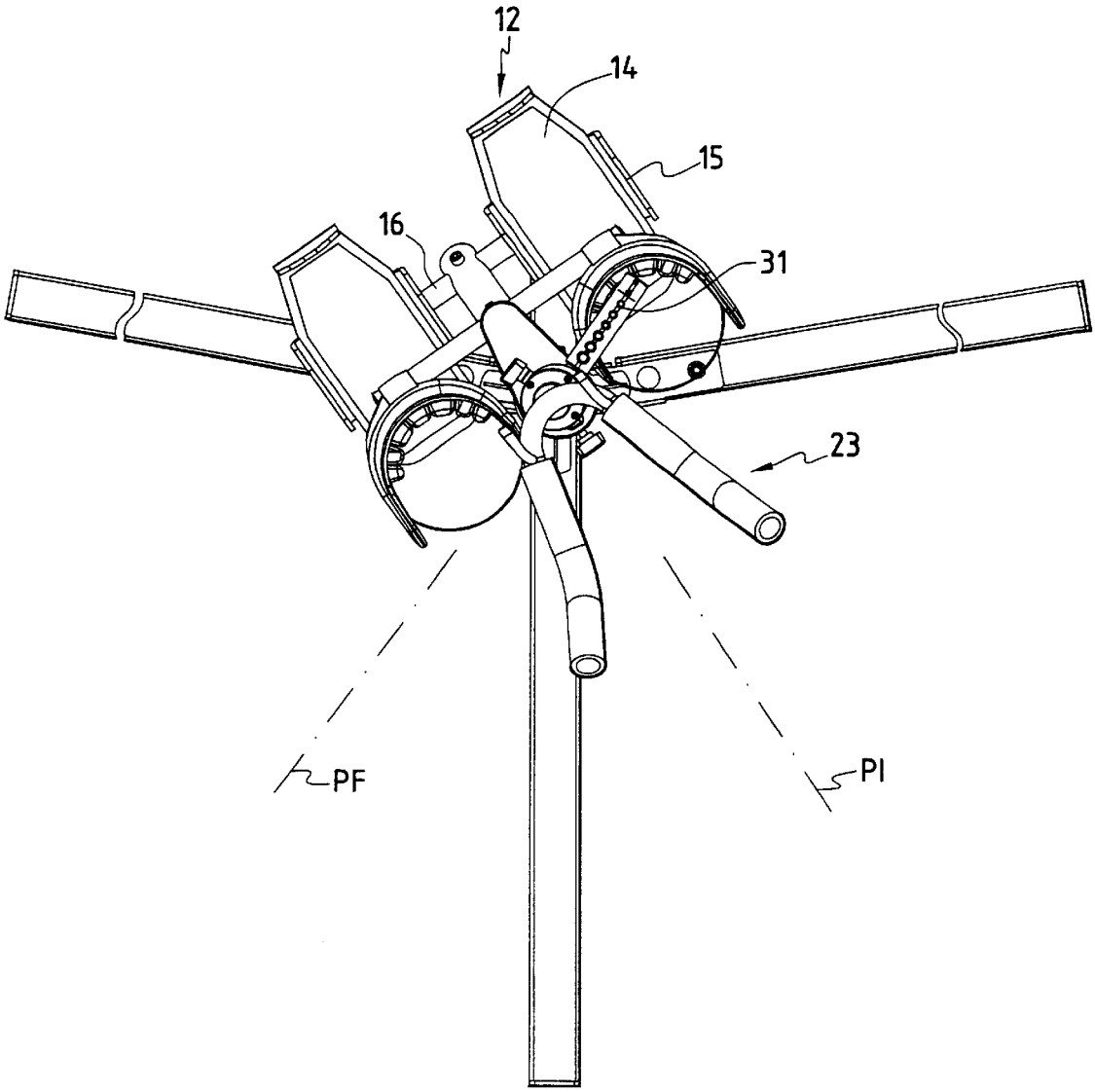
FIGS. 2 and 3 are plan views of the device in accordance with the invention shown in two characteristic positions.
Figure 3:
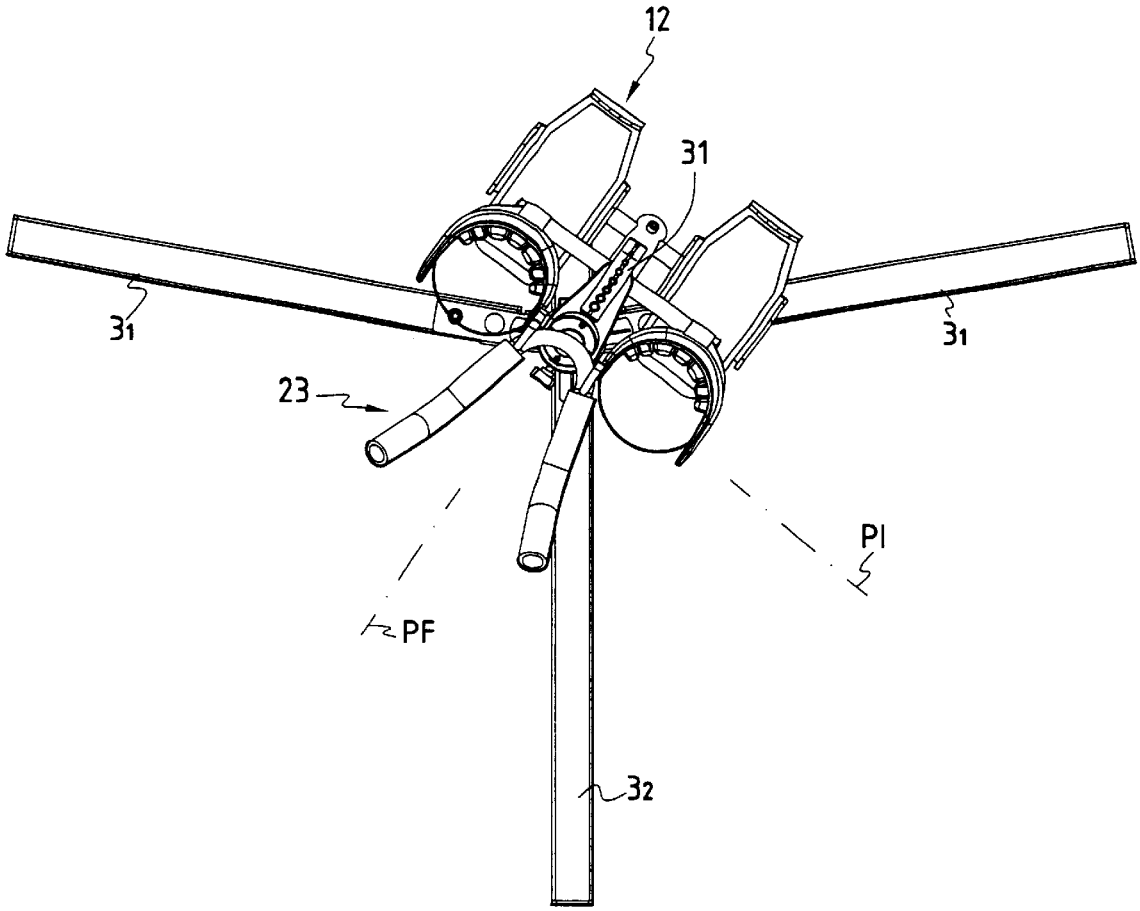
Figure 4:
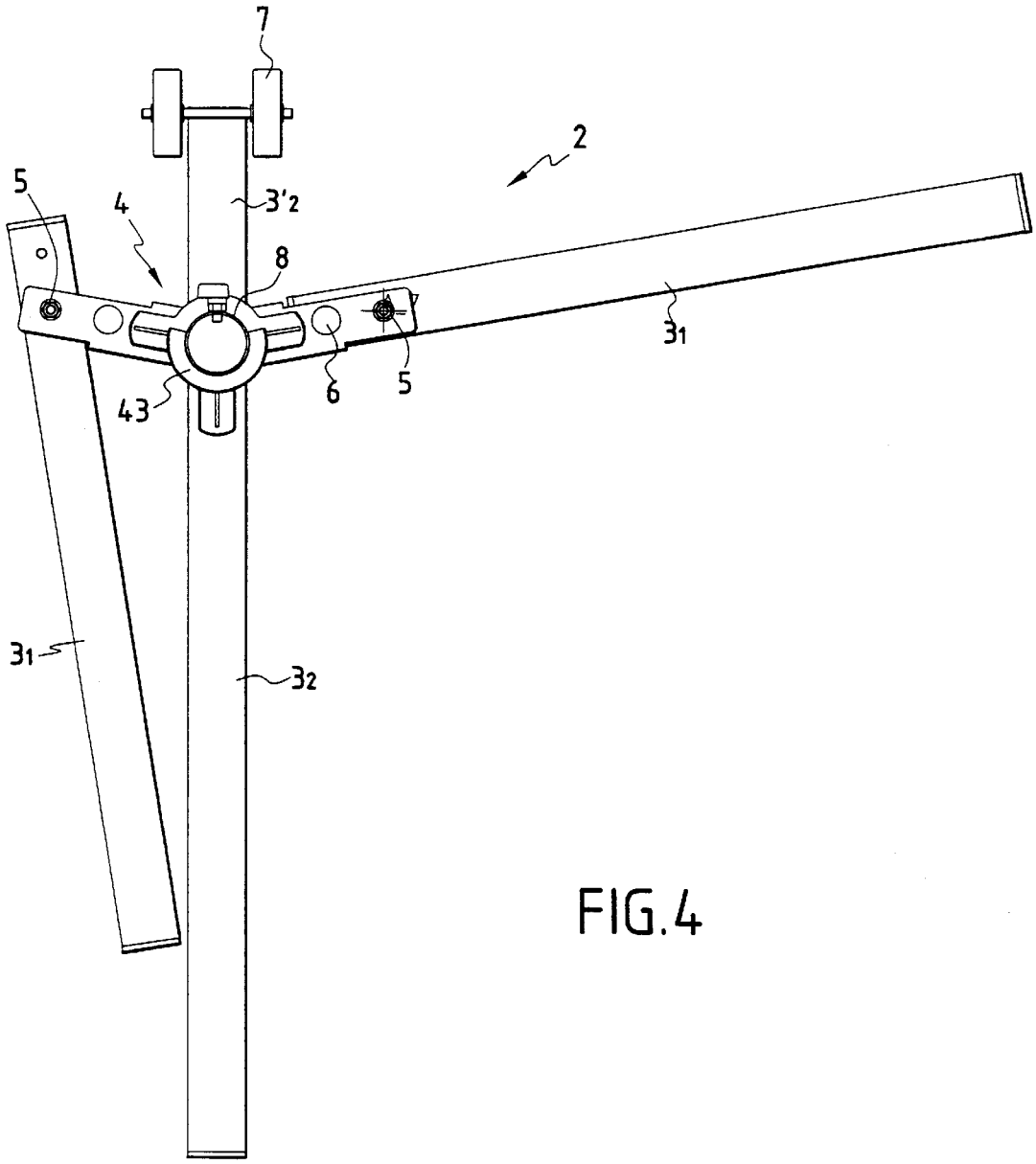
FIG. 4 is a cross-section view on lines II—II of FIG. 1 showing a characteristic detail of the stand of the invention.
Figure 5:
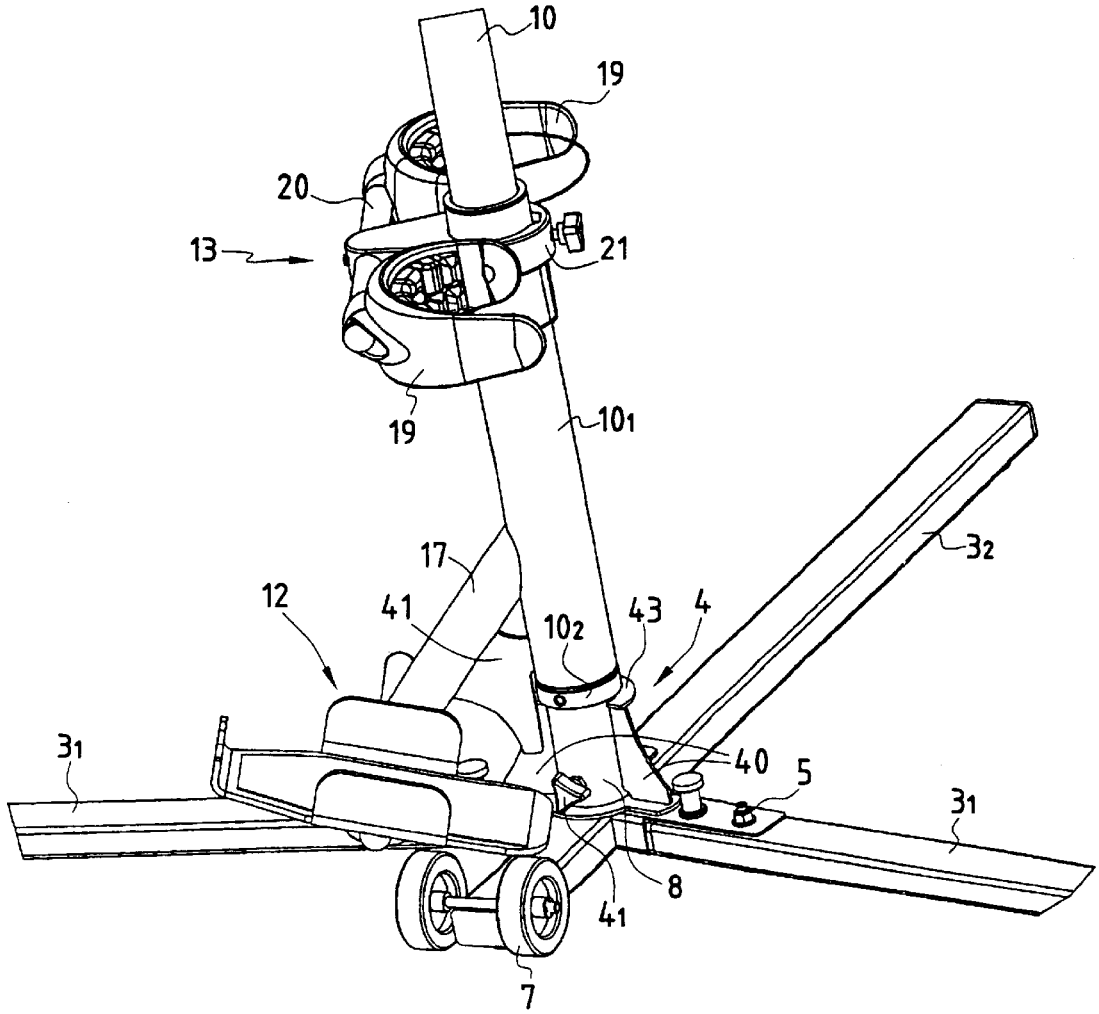
FIG. 5 is a fragmentary perspective view of the device in accordance with the invention.

As can be seen in FIGS. 1 to 3, the invention provides a device 1 adapted to transfer a person from an initial position PI to a final position PF represented diagrammatically by the sagittal plane of that person. The device 1 comprises a stand 2 for standing on the ground to define a support polygon in conventional manner. In the variant shown in particular in FIGS. 4 and 5, the stand 2 comprises three arms extending from a central connection support 4 so as to be generally T-shaped. In a preferred embodiment, two of the arms, namely the side arms $\mathbf{3}_1$ on either side of the central arm $\mathbf{3}_2$, are swing-mounted so as to be capable of being swung into a position substantially parallel with the central arm $\mathbf{3}_2$ when the device 1 is not in use (FIG. 4). For this purpose, each side arm $\mathbf{3}_1$ is mounted to the support 4 via a pivot axis 5 and is fitted with an element 6 for locking the arm in the deployed position.

According to a preferred characteristic, the central arm $\mathbf{3}_2$ extends beyond the central connection support 4 for the arms in the form of an extension $\mathbf{3'}_2$ of short length that contributes to keeping the stand 2 in contact with the ground. The end of the extension $\mathbf{3'}_2$ is preferably fitted with wheels 7 which are mounted so that they do not come into contact with the ground when the central arm $\mathbf{3}_2$ is in its position pressed on the ground. The wheels 7 make it easier to transport the stand 2 when it is in its folded position. For this purpose, the stand 2 is lifted from its end remote from the end carrying the wheels 7 so that the wheels can then roll on the ground.

The support 4 of the stand has a tubular socket 8 which receives the bottom end of a pole 10 rising vertically along an axis X. The pole 10 is preferably prevented from turning relative to the support 4 by means of a lock screw $\mathbf{4}_1$. Thus, the pole 10 can easily be separated from the stand 2 when the device 1 is taken apart.

The pole 10 is fitted with a rest assembly 11 for the lower limbs, constituted by a footrest 12 and by two open leg guards 13 carried by a tube $\mathbf{10}_1$ engaged on the pole 10 so as to be capable of turning about the pole 10. To prevent the tube $\mathbf{10}_1$ from sliding along the pole 10 while it is being removed from the socket 8, the pole 10 is fitted with an abutment ring $\mathbf{10}_2$ that bears against the edge of the socket 8.

As can be seen more clearly in FIGS. 2 to 5, the footrest 12 is conventionally constituted by two pedal plates 14 with respective rims 15 and interconnected by a cross-member 16 carried by a boom 17 fixed to the tube $\mathbf{10}_1$. Naturally, the pedal plates 14 for supporting the feet are located on opposite sides of the pole 10 and can be adjusted in spacing and/or orientation.

The two open leg guards 13 are designed to engage the front of a person's knees so as to bear substantially beneath the tibial plate in order to prevent the lower limbs from moving laterally or in the antero-posterior plane. The two open leg guards 13 are disposed on opposite sides of the pole 10, and each of them is constituted by an arc 19 fixed on a transverse rod 20 supported by a collar 21 for assembly with the tube $\mathbf{10}_1$. For example, the two open leg guards 13 are mounted so as to be adjustable in spacing and/or orientation. The mounting collar 21 preferably has the possibility of being adjusted in height along the tube $\mathbf{10}_1$.

The device 1 of the invention also has a system 22 for transferring a person in the support polygon between the initial position PI and the final position PF that are angularly offset relative to each other.

The transfer system 22 is mounted on the pole 10 and is provided with a suspension assembly 23 for the upper limbs. In the example shown, the suspension assembly 23 is constituted by two handles extending radially from the pole 10 and close to each other. According to a preferred characteristic, the suspension assembly 23 also includes hooks 24 adapted to act as fixing points for straps or the like that are intended to go round the person during the transfer operation.

Figure 6:
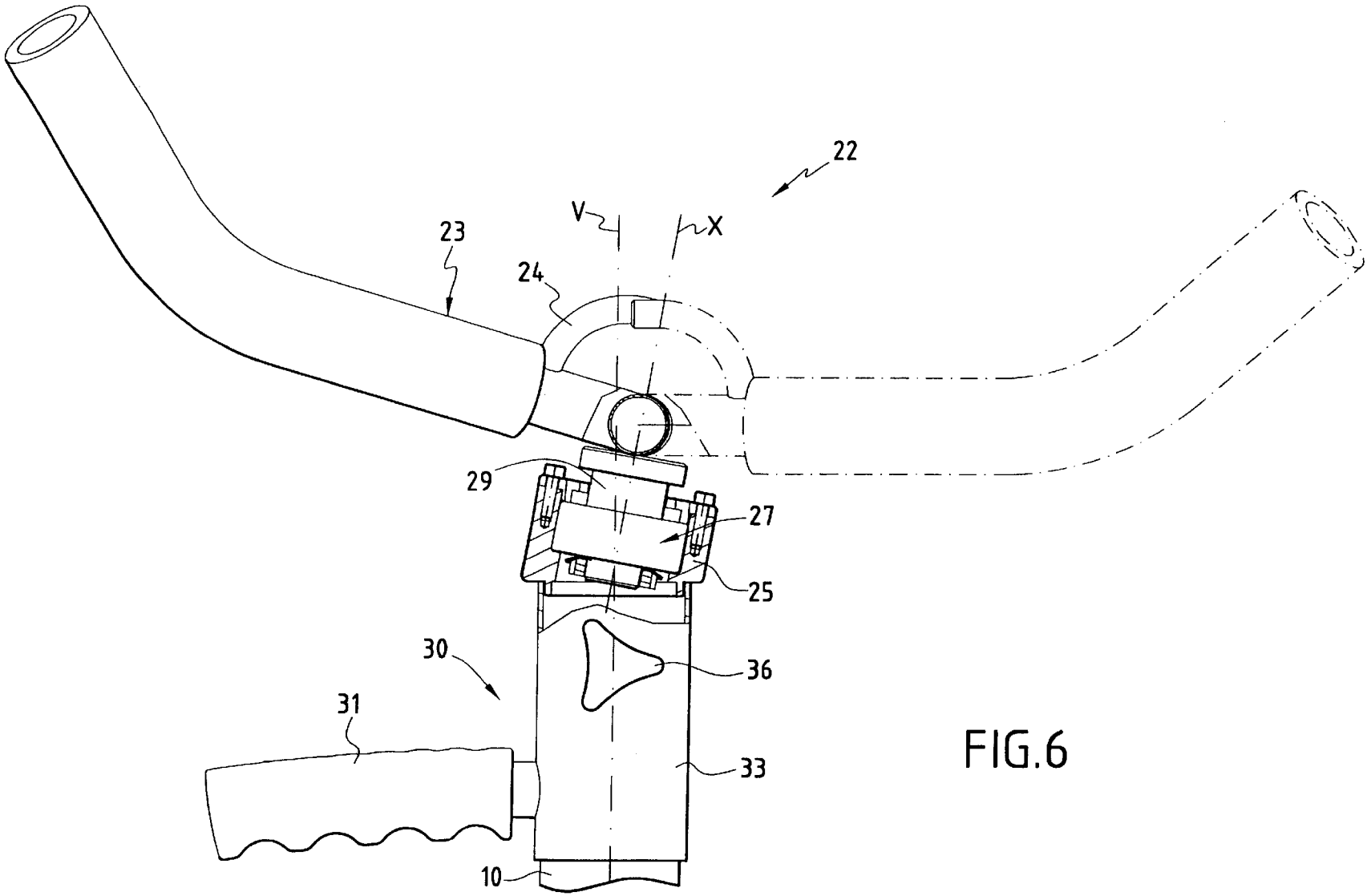
FIG. 6 is a fragmentary elevation view in section showing a detail characteristic of the device of the invention.

As can be seen more clearly from FIG. 6, the suspension assembly 23 is pivotally mounted on the pole 10 to pivot about an axis X that is inclined relative to the vertical V. In the example shown, the transfer system 22 has a guide cup 25 for a ball bearing 27 whose inner ring is constrained to rotate together with the suspension assembly 23 via a shaft 29. Given the way the suspension assembly 23 is mounted to pivot about an axis X that is inclined relative to the vertical V, the suspension assembly 23 follows a trajectory lying in a plane perpendicular to the axis X, i.e. that is itself inclined relative to the vertical V. During this circular trajectory, it should be understood that the suspension assembly 23 moves between a high level and a low level. Insofar as the center of gravity of the suspension assembly 23 is offset from the axis of rotation X, the suspension assembly 23 tends, when placed in a high position (shown on the left of FIG. 6), to return merely under gravity towards its low position (shown in chain-dotted lines on the right of FIG. 6). The purpose of this characteristic is described more precisely in the description below.

According to a preferred characteristic, the device 1 has marking means 30 for identifying the final position PF, i.e. the high level for the suspension assembly 23. In the embodiment shown, the marking means 30 is constituted by a handle 31 projecting from a tubular skirt 33 that forms part of the transfer system 22. Naturally, the marking means 30 could be made in some other way. The tubular skirt 33 which extends the guide cup 25 is engaged on the top end of the pole 10. This tubular skirt 33 is placed in a fixed position relative to the pole 10 by manually driven locking means 36 such as a screw. The transfer system 22 can thus easily be disassembled from the pole 10. It should be observed that the handle 31 also serves advantageously to enable the device 1 to be moved, in particular while it is running on its wheels 7.

The way a device 1 of the invention is used stems directly from the above description.

The device 1 is positioned so as to enable a person to pass from an initial position PI shown in FIG. 2 to a final position PF shown in FIG. 3. In the example shown, the positions PI and PF are angularly offset by substantially about 90°. For this purpose, the person uses the marker means 30 so as to orient them in the desired final position PF, in the example shown. For this purpose, the handle 31 is oriented in the direction of the final position PF and is locked in this position using the manual locking means 36. As can be seen in FIG. 2, the handle 31 is positioned relative to the pole 10 on its side opposite from the final position PF. Naturally, it would also be possible for the handle 31 to be located on the same side as the final position PF.

Once the transfer system 22 has been locked in this way in the above-defined position, the suspension assembly 23 is positioned in the initial position PI where it is in a high position, i.e. in a position higher than the low position in which the suspension assembly 23 will be situated once in the final position PF. The person can then rest the feet on the pedals 14 and engage the legs in the open leg guards 13. The person then hangs onto the suspension assembly 23 using the hands so as to be fully supported by the transfer device 1 of the invention. Given the high level of the suspension assembly 23, it is caused to turn under the weight of the person suspended therefrom. The suspension assembly 23 thus turns so as to move into its low position. Given the way the upper limbs and the body of the person turn as well, the rest assembly 11 for the lower limbs is also caused to turn so as to enable the person to be placed in the final position PF.

The device 1 of the invention thus makes it possible in simple and reliable manner for a person to transfer from one position to another without requiring outside help. Transfer is performed without any external power supply, solely under the effect of gravity.

According to a preferred characteristic, the device 1 has abutments 40 for limiting the extent to which the rest assembly 11 for the lower limbs can turn relative to the pole 10. In the embodiment shown, these limiting abutments 40 are constituted by two plates for stiffening the socket 8, and a spur 41 projecting between the tube 101 and the boom 17 is placed so as to come into abutment against them. Using these abutments 40 ensures that a person is always transferred within the support polygon. According to an advantageous characteristic, the device 1 includes keying means to prevent the pole 10 being mounted in the wrong position on the stand which could lead to the person being positioned outside the support polygon. For this purpose, the socket 8 is provided at its end with a rim 43 extending between the two abutments 40 outside the range in which the spur 41 is authorized to turn. This prevents the pole 10 from being engaged in the socket 8 in the wrong position since the spur 41 then comes into abutment against the rim 43.

The invention is not limited to the example described and shown since various modifications can be made thereto without going beyond its ambit.

What is claimed is:

1. A device for transferring a person, the device comprising:

a stand defining a support polygon;

a pole rising vertically from the stand;

a rest assembly for the lower limbs of a person, the rest assembly being pivotally mounted on the pole; and a person transfer system adapted to move within the support polygon between an initial position and a final position, which positions are angularly offset relative to each other, the transfer system being mounted on the pole, being provided with a suspension assembly for the upper limbs that is pivotally mounted on the pole to pivot about an axis that is inclined relative to the vertical and that is designed to be placed at a high level so as to turn under the effect of the weight of the suspended person to a low level, thereby enabling the person to be transferred.

2. A transfer device according to claim 1, including marking means for identifying the high level for the suspension assembly.

3. A device according to claim 2, wherein the marking means is constituted by a handle extending from the transfer system, which system is mounted so as to be capable of turning relative to the pole, the transfer system being placed in a position that is fixed relative to the pole by manually-driven locking means.

4. A device according to claim 1, wherein the transfer system comprises a guide cup for a ball bearing constrained to turn with the suspension assembly, the guide cup being mounted on an axis that is inclined relative to the vertical.

5. A transfer device according to claim 1, wherein the rest assembly for the lower limbs is constituted by a footrest and two open leg guards.

6. A transfer device according to claim 1, including abutments for limiting turning of the rest assembly for the lower limbs relative to the pole.

7. A transfer device according to claim 1, wherein the stand has a socket for receiving the pole and allowing the pole to be separated from the stand.

8. A transfer device according to claim 1, wherein the stand is constituted by at least three arms, two of which are swing-mounted so that they can be folded along an arm positioned therebetween in a non-use position.

9. A transfer device according to claim 7, wherein the stand is fitted with wheels mounted so as to make no contact with the ground when the stand is in its position pressed against the ground.

10. A transfer device according to claim 1, wherein the suspension assembly has hooks to serve as fixing points for straps designed to go round the person.

* * * * *

UNITED STATES PATENT AND TRADEMARK OFFICE

CERTIFICATE OF CORRECTION

PATENT NO. : 6,742,201 B2
DATED : June 1, 2004
INVENTOR(S) : Francois Porcheron

It is certified that error appears in the above-identified patent and that said Letters Patent is hereby corrected as shown below:

Title page,
Item [75], Inventor, change "Franaois Porcheron" to -- Francois Porcheron --

Signed and Sealed this

Seventeenth Day of August, 2004

JON W. DUDAS
*Acting Director of the United States Patent and Trademark Office*